United States Patent [19]

Nishimatsu et al.

[11] 3,959,162

[45] May 25, 1976

[54] INSULATING OIL

[75] Inventors: Mineaki Nishimatsu, Kyoto; Sadayoshi Mukai, Katano; Kaname Ishida, Kyoto, all of Japan

[73] Assignee: Nissin Electric Co., Ltd., Kyoto, Japan

[22] Filed: Aug. 2, 1974

[21] Appl. No.: 494,342

[30] Foreign Application Priority Data

Aug. 20, 1973 Japan ..... 48-93181

[52] U.S. Cl. ..... 252/63.7; 252/64; 336/94; 252/78; 174/17 LF; 252/49.8

[51] Int. Cl.[2] ..... H01B 3/18; H01F 27/02

[58] Field of Search ..... 260/966; 252/63.7, 64, 252/49.8, 78, 79; 336/94; 174/17 LF

[56] References Cited

UNITED STATES PATENTS 1,721,295 7/1929 Doerflinger ..... 252/63.7

OTHER PUBLICATIONS

Chemical Abstracts, Vol. 77, Col. 77638m.

Chemical Abstracts, Vol. 76, Col. 86589c.

*Primary Examiner*—John D. Welsh

*Attorney, Agent, or Firm*—Christensen, O'Connor, Garrison & Havelka

[57] ABSTRACT

An insulating oil for use in electrical devices, comprising a mixture of trixylenylphosphate and 10% to 40% by volume of insulating oil having a viscosity of 5 cp to 15 cp at 30°C and selected from the group consisting of mineral oil, alkylbenzene, alkylnaphthalene, diallylalkane, 2-diphenylmethylether, 2-diphenylisopropylether, paraffin hydrocarbon oil and naphthene hydrocarbon oil.

11 Claims, No Drawings

INSULATING OIL

BACKGROUND OF THE INVENTION

This invention relates to insulating oil compositions used in oil-filled or oil-immersed electrical devices.

Insulating oil is widely used in various types of electrical devices such as power cables, transformers, capacitors and so on. It has hithereto been customary to use mineral oil or diphenyl chloride as the insulating oil for such electrical devices. Recently, such electrical devices tend to become of greater capacity and more capable of withstanding higher voltages, so that the insulating oil used in them must have characteristics to meet the tendncy.

Mineral oil alone, however, is combustible and inferior in such electrical characteristics as dielectric constant and visible gas generating voltage. While diphenyl chloride is incombustible and superior in the above-mentioned characteristics, it is very toxic to the human body so that the use of this compound is undesirable from the view point of environmental pollution.

Accordingly, the primary object of the invention is to provide an insulating oil composition which has good characteristics as such oil.

Another object of the invention is to provide an insulating oil composition which is superior to mineral oil in electrical characteristics such as dielectric constant, visible gas generating voltage, etc.

Another object of the invention is to provide such an insulating oil composition as aforesaid which is incumbustible and has no toxicity to the human as well as animal life.

In accordance with the invention there is provided an insulating oil composition which comprises a mixture of trixylenylphosphate (which will be referred to as TXP) and an insulating oil having a viscosity of 5 to 15 centipoises (which will be abbreviated to cp) at 30°C, the amount of of the latter oil to be mixed with TXP being 10% to 40% by volume of the mixture. The insulating oil which has a viscosity of 5 cp to 15 cp can be selected from the following group: mineral oil (to be referred to as MO), alkylbenzene (to be referred to as AB), alkylnaphthalene (to be referred to as AN), diallylalkane (to be referred to as DAA), paraffin hydrocarbon oil (to be referred to as PO), naphthene hydrocarbon oil (to be referred to as NO), 2-diphenylmethylether (to be referred to as DME), 2-diphenylisopropylether (to be referred to as DPE), etc.

DETAILED DESCRIPTION OF THE INVENTION AND THE PREFERRED EMBODIMENTS

The combustibility and electrical characteristics of TXP and the above-mentioned insulating oils are given in TABLE 1.

TABLE 1

| Characteristics | Viscosity (cp) (at 30°C) | Specific gravity (at 15°C) | Flash point (°C) | Combustibility |
|---|---|---|---|---|
| Insulating oil | | | | |
| TXP | 103 | 1.12 | 210 | Incombustible |
| MO | 9 | 0.87 | 132 | Combustible |
| AB | 10 | 0.88 | 136 | " |
| AN | 8 | 0.96 | 140 | " |
| DAA | 8 | 0.96 | 150 | " |
| PO | 9 | 0.86 | 132 | " |
| NO | 9 | 0.88 | 136 | " |
| DME | 13 | 0.98 | 134 | " |
| DPE | 14.7 | 0.98 | 139 | " |

| Characteristics | Dielectric constant (at 80°C) | Dielectric loss tangent (%) (at 80°C) | Volume resistivity (Ω-cm) | Visible gas generating voltage (kV/mm) |
|---|---|---|---|---|
| Insulating oil | | | | |
| TXP | 5.99 | 0.21 | $1.0\times10^{14}$ | 57.0 |
| MO | 2.20 | 0.010 | $1.5\times10^{15}$ | 47.0 |
| AB | 2.20 | 0.010 | $2.0\times10^{15}$ | 52.0 |
| AN | 2.47 | 0.010 | $2.5\times10^{15}$ | 65.0 |
| DAA | 2.51 | 0.010 | $1.0\times10^{15}$ | 70.0 |
| PO | 2.20 | 0.010 | $2.5\times10^{15}$ | 40.0 |
| NO | 2.21 | 0.010 | $2.0\times10^{15}$ | 45.0 |
| DME | 3.80 | 0.06 | $1.0\times10^{15}$ | 68.5 |
| DPE | 4.18 | 0.06 | $1.0\times10^{15}$ | 67.0 |

The physical properties such as viscosity, etc, as well as the electrical characteristics such as dielectric constant, visible gas generating voltage, etc of mixtures comprising TXP and 10%, 20%, 30% by volume, respectively, of one or two of the above insulating oils are given in TABLES 2 through 12 in comparison with those of the mixtures comprising TXP and 45% and 50% of one or two of those insulating oils.

In TABLE 2 the material tested comprises a mixture of TXP and MO; in TABLE 3 it comprises a mixture of TXP and AB; in TABLE 4 it comprises a mixture of TXP and AN; in TABLE 5 it comprises a mixture of TXP and DAA; in TABLE 6 it comprises a mixture of TXP and PO; in TABLE 7 it comprises a mixture of TXP and NO; in TABLE 8 it comprises a mixture of TXP and DME; in TABLE 9 it comprises a mixture of TXP and DPE; in TABLE 10 it comprises a mixture of TXP, MO and AN; in TABLE 11 it comprises a mixture of TXP, AN and DME; and in TABLE 12 it comprises a mixture of TXP, MO and DME.

In the above TABLES one or two of the insulating oils are mixed with TXP. If three or more of the insulating oils are mixed with TXP, similar results are obtained to those obtained from the mixture of TXP and one or two of the insulating oils, as will be obvious to those skilled in the art.

The flash point has been measured in the following manner. The oil whose flash point is to be tested is put in a pot, which is tightly closed. The oil is slowly heated while it is being stirred at a constant speed. A thermometer is provided to measure the temperature of the oil in the pot. When the oil approaches the expected flash point, the stirring is stopped whenever the temperature rises a predetermined number of degrees, say, 2°C, whereupon a small window provided in the lid of the pot is opened so that a 7 mm long flame is put in the pot so as to see if the vapor of the oil is ignited. The lowest temperature at which the vapor is ignited is the flash point of that oil.

The combustibility has been tested in the following manner. A clean glass sleeve about 5 mm in diameter and about 20 mm in length is dipped in the insulating oil to be tested for one minute, after which it is taken out of the oil so as to be held horizontal for one minute.

Then a flame having a length of about 5 mm is applied to the sleeve for three seconds, after which the flame is moved away from the sleeve so as to see if there is a burning flame on the sleeve. In the TABLES, the word "combustible" means that there was a burning flame under the above condition while the word "incombustible" means that there was no such burning flame.

The visible gas generating voltage has been measured in the following manner. A voltage is applied to a sheet of paper immersed with the insulating oil to be tested and the voltage is increased until visible gas is generated. The level of the impressed voltage at which visible gas is generated is the visible gas generating voltage. It is well known that as the voltage impressed on the oil-immersed sheet of paper is increased, visible gas is generated immediately before breakdown occurs. Therefore the visible gas generating voltage can be taken as a measure of breakdown of the insulation of the oil-immersed paper.

TABLE 2

| Characteristics | | Viscosity (cp) (at 30°C) | Specific gravity (at 15°C) | Flash point (°C) | Combustibility |
|---|---|---|---|---|---|
| Insulating oil & volume ratio | | | | | |
| TXP | MO | | | | |
| 90 | 10 | 78 | 1.09 | 165 | Incombustible |
| 80 | 20 | 63 | 1.07 | 155 | " |
| 70 | 30 | 48 | 1.04 | 151 | " |
| 60 | 40 | 38 | 1.02 | 146 | " |
| 55 | 45 | 34 | 1.00 | 144 | Combustible |
| 50 | 50 | 30 | 0.99 | 142 | " |

| Characteristics | | Dielectric constant (at 80°C) | Dielectric loss tangent (%) (at 80°C) | Volume resistivity (Ω-cm) | Visible gas generating voltage (kV/mm) |
|---|---|---|---|---|---|
| Insulating oil & volume ratio | | | | | |
| TXP | MO | | | | |
| 90 | 10 | 5.07 | 0.21 | $1.0\times10^{14}$ | 57.0 |
| 80 | 20 | 4.85 | 0.20 | $1.5\times10^{14}$ | 57.0 |
| 70 | 30 | 4.38 | 0.15 | $3.9\times10^{14}$ | 56.5 |
| 60 | 40 | 3.92 | 0.12 | $7.0\times10^{14}$ | 56.2 |
| 55 | 45 | 3.70 | 0.10 | $9.0\times10^{14}$ | 55.8 |
| 50 | 50 | 3.50 | 0.08 | $9.0\times10^{14}$ | 55.2 |

TABLE 3

| Characteristics | | Viscosity (cp) (at 30°C) | Specific gravity (at 15°C) | Flash point (°C) | Combustibility |
|---|---|---|---|---|---|
| Insulating oil & volume ratio | | | | | |
| TXP | AB | | | | |
| 90 | 10 | 79 | 1.09 | 168 | Incombustible |
| 80 | 20 | 63 | 107 | 160 | " |
| 70 | 30 | 52 | 1.04 | 153 | " |
| 60 | 40 | 40 | 1.02 | 148 | " |
| 55 | 45 | 34 | 1.00 | 148 | Combustible |
| 50 | 50 | 32 | 0.94 | 145 | " |

| Characteristics | | Dielectric constant (at 80°C) | Dielectric loss tangent (%) (at 80°C) | Volume resistivity (Ω-cm) | Visible gas generating voltage (kV/mm) |
|---|---|---|---|---|---|
| Insulating oil & volume ratio | | | | | |
| TXP | AB | | | | |
| 90 | 10 | 5.06 | 0.21 | $1.0\times10^{14}$ | 57.0 |
| 80 | 20 | 4.85 | 0.20 | $1.3\times10^{14}$ | 57.0 |
| 70 | 30 | 4.38 | 0.16 | $4.0\times10^{14}$ | 56.8 |
| 60 | 40 | 3.92 | 0.13 | $7.2\times10^{14}$ | 56.2 |
| 55 | 45 | 3.70 | 0.10 | $8.5\times10^{14}$ | 56.5 |
| 50 | 50 | 3.50 | 0.08 | $9.5\times10^{14}$ | 56.0 |

TABLE 4

| Characteristics | | Viscosity (cp) (at 30°C) | Specific gravity (at 15°C) | Flash point (°C) | Combustibility |
|---|---|---|---|---|---|
| Insulating oil % volume ratio | | | | | |
| TXP | AN | | | | |
| 90 | 10 | 75 | 1.11 | 173 | Incombustible |
| 80 | 20 | 60 | 1.09 | 163 | " |
| 70 | 30 | 47 | 1.07 | 158 | " |
| 60 | 40 | 36 | 1.05 | 154 | " |
| 55 | 45 | 32 | 1.04 | 153 | Combustible |
| 50 | 50 | 28 | 1.03 | 151 | " |

| Characteristics | | Dielectric constant (at 80°C) | Dielectric loss tangent (%) (at 80°C) | Volume resistivity (Ω-cm) | Visible gas generating voltage (kV/mm) |
|---|---|---|---|---|---|
| Insulating oil & volume ratio | | | | | |
| TXP | AN | | | | |
| 90 | 10 | 5.25 | 0.20 | $1.0\times10^{14}$ | 58.0 |
| 80 | 20 | 5.05 | 0.20 | $1.8\times10^{14}$ | 58.5 |
| 70 | 30 | 4.58 | 0.17 | $4.0\times10^{14}$ | 59.5 |
| 60 | 40 | 4.15 | 0.13 | $7.5\times10^{14}$ | 61.0 |
| 55 | 45 | 3.90 | 0.10 | $8.8\times10^{14}$ | 61.5 |
| 50 | 50 | 3.80 | 0.09 | $9.0\times10^{14}$ | 62.0 |

TABLE 5

| Characteristics | | Viscosity (cp) (at 30°C) | Specific gravity (at 15°C) | Flash point (°C) | Combustibility |
|---|---|---|---|---|---|
| Insulating oil & volume ratio | | | | | |
| TXP | DAA | | | | |
| 90 | 10 | 75 | 1.10 | 175 | Incombustible |
| 80 | 20 | 62 | 1.09 | 164 | " |
| 70 | 30 | 48 | 1.07 | 160 | " |
| 60 | 40 | 35 | 1.05 | 152 | " |
| 55 | 45 | 31 | 1.03 | 150 | Combustible |
| 50 | 50 | 28 | 1.01 | 150 | " |

| Characteristics | | Dielectric constant (at 80°) | Dielectric loss tangent (%) (at 80°C) | Volume resistivity (Ω-cm) | Visible gas generating voltage (kV/mm) |
|---|---|---|---|---|---|
| Insulating oil & volume ratio | | | | | |
| TXP | DAA | | | | |
| 90 | 10 | 5.26 | 0.20 | $1.0\times10^{14}$ | 60.0 |
| 80 | 20 | 5.06 | 0.20 | $2.0\times10^{14}$ | 59.0 |
| 70 | 30 | 4.58 | 0.20 | $4.0\times10^{14}$ | 61.5 |
| 60 | 40 | 4.16 | 0.14 | $7.0\times10^{14}$ | 62.5 |
| 55 | 45 | 3.81 | 0.09 | $8.0\times10^{14}$ | 63.0 |
| 50 | 50 | 3.57 | 0.07 | $8.5\times10^{14}$ | 63.5 |

TABLE 6

| Characteristics | | Viscosity (cp) (at 30°C) | Specific gravity (at 15°C) | Flash point (°C) | Combustibility |
|---|---|---|---|---|---|
| Insulating oil & volume ratio | | | | | |
| TXP | PO | | | | |
| 90 | 10 | 76 | 1.04 | 170 | Incombustible |
| 80 | 20 | 64 | 1.04 | 160 | " |
| 70 | 30 | 47 | 1.03 | 156 | " |
| 60 | 40 | 35 | 1.00 | 148 | " |
| 55 | 45 | 32 | 0.98 | 144 | Combustible |
| 50 | 50 | 30 | 0.97 | 142 | " |

| Characteristics | | Dielectric constant (at 80°C) | Dielectric loss tangent (%) (at 80°) | Volume resistivity (Ω-cm) | Visible gas generating voltage (kV/mm) |
|---|---|---|---|---|---|
| Insulating oil & volume ratio | | | | | |
| TXP | PO | | | | |
| 90 | 10 | 5.18 | 0.20 | $1.0\times10^{14}$ | 57.0 |
| 80 | 20 | 4.96 | 0.20 | $2.0\times10^{14}$ | 56.5 |
| 70 | 30 | 4.50 | 0.14 | $3.5\times10^{14}$ | 56.0 |

TABLE 6-continued

| Characteristics | | Viscosity (cp) (at 30°C) | Specific gravity (at 15°C) | Flash point (°C) | Combustibility |
|---|---|---|---|---|---|
| 60 | 40 | 4.04 | 0.12 | $8.0\times10^{14}$ | 55.0 |
| 55 | 45 | 3.62 | 0.10 | $9.0\times10^{14}$ | 53.0 |
| 50 | 50 | 3.41 | 0.08 | $9.5\times10^{14}$ | 51.0 |

TABLE 7

| Characteristics | | Viscosity (cp) (at 30°C) | Specific gravity (at 15°C) | Flash point (°C) | Combustibility |
|---|---|---|---|---|---|
| Insulating oil % volume ratio | | | | | |
| TXP | NO | | | | |
| 90 | 10 | 76 | 1.10 | 172 | Incombustible |
| 80 | 20 | 65 | 1.08 | 165 | " |
| 70 | 30 | 46 | 1.05 | 158 | " |
| 60 | 40 | 34 | 1.03 | 148 | " |
| 55 | 45 | 32 | 0.95 | 146 | Combustible |
| 50 | 50 | 30 | 0.91 | 144 | " |

| Characteristics | | Dielectric constant (at 80°C) | Dielectric loss tangent (%) (at 80°C) | Volume resistivity (Ω-cm) | Visible gas generating voltage (kV/mm) |
|---|---|---|---|---|---|
| Insulating oil & volume ratio | | | | | |
| TXP | NO | | | | |
| 90 | 10 | 5.18 | 0.20 | $1.0\times10^{14}$ | 57.5 |
| 80 | 20 | 4.98 | 0.20 | $1.0\times10^{14}$ | 57.0 |
| 70 | 30 | 4.50 | 0.15 | $3.5\times10^{14}$ | 56.5 |
| 60 | 40 | 4.04 | 0.12 | $8.0\times10^{14}$ | 55.0 |
| 55 | 45 | 3.62 | 0.10 | $9.0\times10^{14}$ | 54.0 |
| 50 | 50 | 3.41 | 0.08 | $1.0\times10^{15}$ | 53.0 |

TABLE 8

| Characteristics | | Viscosity (cp) (at 30°C) | Specific gravity (at 15°C) | Flash point (°C) | Combustibility |
|---|---|---|---|---|---|
| Insulating oil & volume ratio | | | | | |
| TXP | DME | | | | |
| 90 | 10 | 80 | 1.10 | 172 | Incombustible |
| 80 | 20 | 68.5 | 1.09 | 164 | " |
| 70 | 30 | 55 | 1.07 | 158 | " |
| 60 | 40 | 38 | 1.05 | 148 | " |
| 55 | 45 | 30 | 1.03 | 144 | Combustible |
| 50 | 50 | 26 | 1.02 | 142 | " |

| Characteristics | | Dielectric constant (at 80°C) | Dielectric loss tangent (%) (at 80°C) | Volume resistivity (Ω-cm) | Visible gas generating voltage (kV/mm) |
|---|---|---|---|---|---|
| Insulating oil & volume ratio | | | | | |
| TXP | DME | | | | |
| 90 | 10 | 5.45 | 0.30 | $1.0\times10^{14}$ | 60.0 |
| 80 | 20 | 5.20 | 0.25 | $2.0\times10^{14}$ | 61.0 |
| 70 | 30 | 5.05 | 0.25 | $3.0\times10^{14}$ | 61.5 |
| 60 | 40 | 4.60 | 0.20 | $7.5\times10^{14}$ | 62.0 |
| 55 | 45 | 4.50 | 0.18 | $8.0\times10^{14}$ | 64.0 |
| 50 | 50 | 4.40 | 0.17 | $8.5\times10^{14}$ | 65.0 |

TABLE 9

| Characteristics | | Viscosity (cp) (at 30°C) | Specific gravity (at 15°C) | Flash point (°C) | Combustibility |
|---|---|---|---|---|---|
| Insulating oil & volume ratio | | | | | |
| TXP | DPE | | | | |
| 90 | 10 | 83 | 1.10 | 172 | Incombustible |
| 80 | 20 | 74 | 1.08 | 168 | " |
| 70 | 30 | 61 | 1.06 | 160 | " |
| 60 | 40 | 43 | 1.05 | 150 | " |
| 55 | 45 | 40 | 1.03 | 146 | Combustible |
| 50 | 50 | 38 | 1.02 | 142 | " |

TABLE 9-continued

| Characteristics | | Viscosity (cp) (at 30°C) | Specific gravity (at 15°C) | Flash point (°C) | Combustibility |
|---|---|---|---|---|---|
| Characteristics | | Dielectric constant (at 80°C) | Dielectric loss tangent (%) (at 80°C) | Volume resistivity (Ω-cm) | Visible gas generating voltage (kV/mm) |
| Insulating oil & volume ratio | | | | | |
| TXP | DPE | | | | |
| 90 | 10 | 5.75 | 0.31 | $1.0\times10^{14}$ | 59.0 |
| 80 | 20 | 5.65 | 0.28 | $2.0\times10^{14}$ | 59.0 |
| 70 | 30 | 5.50 | 0.24 | $3.5\times10^{14}$ | 60.5 |
| 60 | 40 | 5.05 | 0.20 | $7.0\times10^{14}$ | 61.0 |
| 55 | 45 | 4.85 | 0.18 | $8.5\times10^{14}$ | 62.0 |
| 50 | 50 | 4.70 | 0.16 | $9.0\times10^{14}$ | 63.0 |

TABLE 10

| Characteristics | | | Viscosity (cp) (at 30°C) | Specific gravity (at 15°C) | Flash point (°C) | Combustibility |
|---|---|---|---|---|---|---|
| Insulating oil & volume ratio | | | | | | |
| TXP | MO | AN | | | | |
| 90 | 5 | 5 | 77 | 1.09 | 166 | Incombustible |
| 80 | 10 | 10 | 62 | 1.07 | 162 | " |
| 70 | 10 | 20 | 46 | 1.05 | 156 | " |
| 60 | 20 | 20 | 37 | 1.03 | 150 | " |
| 55 | 30 | 25 | 32 | 1.02 | 146 | Combustible |
| 50 | 20 | 30 | 28 | 1.01 | 145 | " |
| Characteristics | | | Dielectric constant (at 80°C) | Dielectric loss tangent (%) (at 80°C) | Volume resistivity (Ω-cm) | Visible gas generating voltage (kV/mm) |
| Insulating oil & volume ratio | | | | | | |
| TXP | MO | AN | | | | |
| 90 | 5 | 5 | 5.13 | 0.20 | $1.0\times10^{14}$ | 57.5 |
| 80 | 10 | 10 | 4.91 | 0.20 | $1.5\times10^{14}$ | 58.0 |
| 70 | 10 | 20 | 4.47 | 0.15 | $4.0\times10^{14}$ | 59.0 |
| 60 | 20 | 20 | 4.07 | 0.12 | $7.0\times10^{14}$ | 58.0 |
| 55 | 30 | 25 | 3.85 | 0.10 | $9.0\times10^{14}$ | 57.5 |
| 50 | 20 | 30 | 3.65 | 0.08 | $9.0\times10^{14}$ | 58.0 |

TABLE 11

| Characteristics | | | Viscosity (cp) (at 30°C) | Specific gravity (at 15°C) | Flash point (°C) | Combustibility |
|---|---|---|---|---|---|---|
| Insulating oil & volume ratio | | | | | | |
| TXP | AN | IME | | | | |
| 90 | 5 | 5 | 81 | 1.14 | 166 | Incombustible |
| 80 | 10 | 10 | 65 | 1.11 | 158 | " |
| 70 | 10 | 20 | 54 | 1.07 | 154 | " |
| 60 | 20 | 20 | 43 | 1.04 | 149 | " |
| 55 | 30 | 25 | 38 | 1.02 | 147 | Combustible |
| 50 | 20 | 30 | 34 | 1.00 | 145 | " |
| Characteristics | | | Dielectric constant (at 80°C) | Dielectric loss tangent (%) (at 80°C) | Volume resistivity (Ω-cm) | Visible gas generating voltage (kV/mm) |
| Insulating oil & volume ratio | | | | | | |
| TXP | AN | DME | | | | |
| 90 | 5 | 5 | 5.44 | 0.28 | $1.5\times10^{14}$ | 58.0 |
| 80 | 10 | 10 | 5.23 | 0.25 | $2.7\times10^{14}$ | 57.5 |
| 70 | 10 | 20 | 4.98 | 0.24 | $3.2\times10^{14}$ | 59.5 |
| 60 | 20 | 20 | 4.54 | 0.20 | $7.8\times10^{14}$ | 61.5 |
| 55 | 30 | 25 | 4.26 | 0.16 | $8.3\times10^{14}$ | 62.5 |
| 50 | 20 | 30 | 4.42 | 0.15 | $8.5\times10^{14}$ | 62.5 |

TABLE 12

| Characteristics | | | Viscosity (cp) (at 30°C) | Specific gravity (at 15°C) | Flash point (°C) | Combustibility |
|---|---|---|---|---|---|---|
| Insulating oil & volume ratio | | | | | | |
| TXP | MO | DME | | | | |
| 90 | 5 | 5 | 82 | 1.12 | 165 | Incombustible |
| 80 | 10 | 10 | 68 | 1.09 | 156 | " |
| 70 | 10 | 20 | 55 | 1.05 | 152 | " |
| 60 | 20 | 20 | 44 | 1.03 | 147 | " |
| 55 | 30 | 25 | 40 | 1.02 | 145 | Combustible |
| 50 | 20 | 30 | 35 | 0.99 | 142 | " |

| Characteristics | | | Dielectric constant (at 80°C) | Dielectric loss tangent (%) (at 80°C) | Volume resistivity (Ω-cm) | Visible gas generating voltage (kV/mm) |
|---|---|---|---|---|---|---|
| Insulating oil & volume ratio | | | | | | |
| TXP | MO | DME | | | | |
| 90 | 5 | 5 | 5.32 | 0.28 | $1.5\times10^{14}$ | 57.0 |
| 80 | 10 | 10 | 5.03 | 0.25 | $2.5\times10^{14}$ | 57.0 |
| 70 | 10 | 20 | 4.82 | 0.25 | $3.0\times10^{14}$ | 57.0 |
| 60 | 20 | 20 | 4.32 | 0.20 | $7.8\times10^{14}$ | 56.0 |
| 55 | 30 | 20 | 4.02 | 0.17 | $8.5\times10^{14}$ | 55.5 |
| 50 | 20 | 30 | 4.23 | 0.16 | $8.7\times10^{14}$ | 56.0 |

From the above TABLES it is apparent that the mixtures prepared in accordance with the invention have higher dielectric constants than that of mineral oil which is 2.20 at 80°C. Also the mixed oils of the invention have higher visible gas generating voltage than that of mineral oil which is 47.0 kV/mm. This means that the mixed oils prepared in accordance with the invention are superior to the conventional insulating oil comprising mineral oil alone with respect to dielectric constant and visible gas generating voltage.

With respect to combustibility, mineral oil is combustible and the mixtures which comprises TXP and 45% and 50%, respectively, of the insulating oils are also combustible. AB, AN, DAA and all the other insulating oils to be mixed with TXP are individually combustible, so that if the amount of the oil mixed with TXP exceeds 50% by volume, the resultant mixture will apparently become combustible. Therefore, the maximum volme of the insulating oil or oils to be mixed with TXP is determined to be 40% so as to prevent the resultant mixture from becoming combustible.

From the above TABLES it can be seen that as the volume of the insulating oil or oils to be mixed with TXP is increased, the dielectric constant of the resultant mixture becomes lower. Therefore the volume to be mixed with TXP should not be very large.

The experiments have disclosed that TXP alone is incombustible. However, the viscosity of the compound is as high as 76.0 cp, so that if it alone is used as insulating oil in an electrical device, problems occur due to its poor cooling effect and low degree of immersion.

Unlike diphenyl chloride, the mixed insulating oils of the invention have little toxicity, so that their use in electrical devices are desirable from the viewpoint of environmental pollution and sanitation.

As can be seen from the foregoing description, the insulating oil compositions of this invention are incombustible and superior to the conventional mineral oil in electrical characteristics such dielectric constant, visible gas generating voltage and have little or no toxicity, so that the oil compositions of the invention are highly valued in industrial use.

What we claim is:

1. An insulating oil composition for use in electrical devices, comprising trixylenylphosphate and from 10% to 40% by volume of insulating oil having a viscosity of 5 cp to 15 cp at 30°C.

2. An insulating oil composition for use in electrical devices, comprising trixylenylphosphate and from 10% to 40% by volume of a single kind of insulating oil having a viscosity of 5 cp to 10 cp at 30°C.

3. An insulating oil composition for use in electrical devices, comprising trixylenylphosphate and from 10% to 40% by volume of a mixture of a plurality of insulating oils having a viscosity of 5 cp to 15 cp at 30°C.

4. The composition of claim 2, wherein said insulating oil is a mineral oil.

5. The composition of claim 2, wherein said insulating oil is an alkylbenzene.

6. The composition of claim 2, wherein said insulating oil is an alkylnaphthalene.

7. The composition of claim 2, wherein said insulating oil is 2-diphenylmethylether.

8. The composition of claim 2, wherein said insulating oil is 2-diphenylisopropylether.

9. The composition of claim 2, wherein said insulating oil is a paraffin hydrocarbon oil.

10. The composition of claim 2, wherein said insulating oil is a naphthene hydrocarbon oil.

11. The composition of claim 3, wherein said plurality of insulating oils are selected from the group consisting of mineral oils, alkylbenzenes, alkylnaphthalenes, 2-diphenylmethylether, 2-diphenylisopropylether, paraffin hydrocarbon oils and naphthene hydrocarbon oils.

* * * * *